United States Patent [19]

Kuroiwa

[11] 4,172,346

[45] Oct. 30, 1979

[54] CONSTRUCTION PANELS

[76] Inventor: Ichio Kuroiwa, 750-186, Shirane-cho, Asahi-ku, Yokohama-shi, Kanagawa-ken, Japan

[21] Appl. No.: 860,102

[22] Filed: Dec. 13, 1977

Related U.S. Application Data

[63] Continuation-in-part of Ser. No. 770,743, Feb. 22, 1977, abandoned.

[30] Foreign Application Priority Data

Apr. 19, 1976 [JP] Japan ..... 51-44701

[51] Int. Cl.[2] ..... E04B 1/54; E04B 1/64

[52] U.S. Cl. ..... 52/408; 52/432; 52/519; 52/542; 52/583

[58] Field of Search ..... 52/408, 542, 583, 519, 52/432, 440

[56] References Cited

U.S. PATENT DOCUMENTS

| | | | |
|---|---|---|---|
| Re. 18,349 | 2/1932 | Lupof | 52/569 |
| 782,810 | 2/1905 | Murphy et al. | 52/411 |
| 873,739 | 12/1907 | Edmondson | 52/411 |
| 906,025 | 12/1908 | Howe | 52/569 |
| 1,441,362 | 1/1923 | Malcolm | 52/570 X |
| 1,666,199 | 4/1928 | Fitzpatrick | 52/571 |
| 1,892,498 | 12/1932 | Adams | 52/411 |
| 1,908,414 | 5/1933 | Finley | 52/412 X |
| 2,006,650 | 7/1935 | O'Reilly | 52/519 X |
| 2,713,710 | 7/1955 | Holland | 52/600 X |
| 3,197,933 | 8/1965 | Burns et al. | 52/574 X |
| 3,290,840 | 12/1966 | Middendorf | 52/223 R |
| 3,417,570 | 12/1968 | Pegan et al. | 52/16 X |

FOREIGN PATENT DOCUMENTS

| | | | |
|---|---|---|---|
| 245989 | 2/1961 | Australia | 52/574 |
| 716910 | 12/1931 | France | 52/413 |
| 916949 | 9/1946 | France | 52/542 |
| 553683 | 6/1943 | United Kingdom | 52/542 |
| 904796 | 8/1962 | United Kingdom | 52/408 |
| 1009505 | 11/1965 | United Kingdom | 52/542 |
| 1448467 | 9/1976 | United Kingdom | 52/408 |

*Primary Examiner*—Alfred C. Perham
*Attorney, Agent, or Firm*—Haseltine, Lake & Waters

[57] ABSTRACT

A construction panel suitable for flat roofs, walls, floors and the like. The panel is preformed employing a sheet steel member embedded therein having in addition intersecting reinforcement of steel bars. The panel is of cementitious material bent on both sides and formed in a U-shape.

3 Claims, 6 Drawing Figures

CONSTRUCTION PANELS

BACKGROUND OF THE INVENTION

The present invention is a continuation-in-part of our copending application entitled CONSTRUCTIONAL PANELS, Ser. No. 770,743; filed Feb. 22, 1977 and now abandoned.

More particularly the present invention is directed to an improved construction panel employed in flat roofs, walls, floors, etc. exhibiting favorable physical properties particularly waterproofing characteristics.

The roofs of buildings are required having no leakage of rain water; no aging due to using for a long time; and further, to be walkable and exhibit superior qualities in thermal insulation and noise insulation.

In the case of a building having a walkable flat roof aiming at satisfying the above conditions, drainage conditions are not good with the result that rain water is apt to stay on the roof, because the roof is level.

Usually an upper part of a building is covered only by a slab or existing roof-deck, causing the rain water to leak in through the concrete or the joints in them. Therefore, after the above-mentioned upper part is covered by a slab or the existing roof-decks, waterproof layers such as asphalt are provided on them. Then, light weight concrete is used to protect the waterproof layers.

The above procedure has been recognized as useful, but since the waterproof layers are made of organic material such as asphalt and vinyl, they become weak and inferior by aging under the action of: building movement, temperature changes, ultraviolet rays, ozone, and so on, and the waterproof layers start to exhibit cracks which cause the leaks.

Therefore, the duration life of the roofs of the existing buildings having walking flat roofs is at most 10 years, while that of other parts of the buildings can be more than 60 years.

In addition to the above fact, the execution of the work upon the waterproof layers is so difficult that sufficient care and much experience is required. Furthermore, even if sheet steel instead of the organic waterproof layers are used, the joint of the steel sheets cannot continue perfect watertightness for a long time. This is due to the action of the building movement, temperature changes, and so on. In addition, though a welded joint is a means of attaining watertightness; in this case, the weld bead of the joint inevitably is so long and therefore the weld strain is so large, that the execution of the work cannot be carried out. Further, when the weld strain becomes too large, the residual stress accumulates, and the steel sheets will become brittle and complete destruction takes place. Therefore, this approach has no practical use.

Also, a method employing a thin metal layer for waterproofing of the roof of a building has been carried out on pitched roofs for a long time. In this method, the problems of: corrosion of metals, noise insulation, thermal insulation, and wind pressure resistance have not been satisfactorily solved. If these metals are laid on horizontal beam as a walking flat roof, rain water will stay on the roof to readily leak in through the connecting parts of the metal. Also, walking on the roof will cause much damage to the metal and the roof will have holes, so that this method is also unpractical.

It is well known that the corrosion of steel is checked by covering up the whole surface with cementitious material and, further, that the cementitious material tends to remove the pre-existing rust of the steel. However, in employing this principle, it is necessary that the material for a walkable flat roof which is to act as the water-resisting layer have the same durability as other parts of the building. More particularly, that the welded joints that are formed do not bring about weld strain and have sufficient strength and exhibit perfect watertightness in the horizontal direction. Such structure being of a pre-formed type having many advantages, has not been found out up to the present time.

SUMMARY OF THE INVENTION

The main advantage of the present invention is to provide a construction panel used for a walkable flat roof, being light, strong and acting as a complete water-resistant layer. The welded joints being formed so as not to bring about weld strain while having the same durability as other parts of the building. Furthermore, such structure has excellent fire resistance, wind pressure resistance, thermal insulation, and sound insulation. In the advantages result by embedding and attaching a steel sheet in the panel and forming the structure into a U-shaped module made of cementitious material having a reinforcement system.

Another advantage of the present invention is to provide a construction panel with which construction work is easy and fast by pre-forming the panel in the factory.

The principal feature of the present invention is directed to an improved pre-formed construction panel made of cementitious material having a reinforcement system, employing a sheet metal water-resisting layer of steel is embedded and attached to said cementitious material; said improvement comprising said layer defined by edges of its longitudinal sides bent into a U-shape as seen in the transverse direction, and said panel reinforcement means disposed upon the entire surface of said layer of steel having strengthened joints exhibiting watertightness by welding said U-shaped sheet metal at respective joints in the longitudinal direction to thereby form a monolithic construction panel. Also within the scope of the invention is to provide a cementitious material consisting of light weight concrete comprising a blended expansive mixture. The cementitious material can consist of asbestos cement.

By using a vibration sytem during making and expanding the admixture in concrete (since dense concrete is obtained), the shrinkage cracks are checked, the bond strength becomes good, the neutralization of the concrete is restrained, and resistance to chemicals and increased durability are increased.

Further, by forming the sheet metal into a U-shape it is possible to shorten the weld beads of the joints and the weld strain can be removed. By embedding the sheet metal in the panel, it follows that even if the panel receives a partial impact and is subjected to temperature changes, water resistance and the strength are maintained.

It is the main object of the present invention to overcome the defects of the prior art.

Another object is to provide a panel suitable for roof construction exhibiting favorable waterproofing characteristics which can be pre-formed.

Other advantages and objects of the present invention will become apparent with reference to the specification, claims and attached drawings.

BRIEF DESCRIPTION OF THE DRAWINGS

FIG. 1*a* is a top view of two abutting panels in end-to-end relation.

DESCRIPTION OF THE PREFERRED EMBODIMENTS

Figure 1:
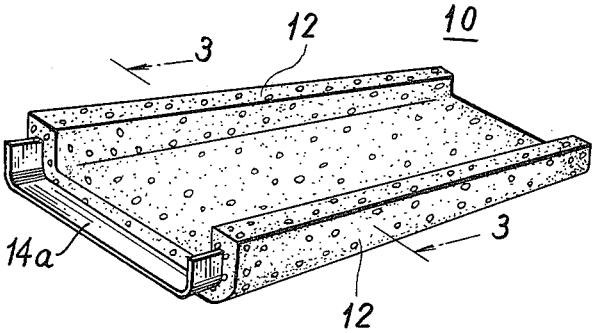
FIG. 1*a* is a perspective view of a constructional panel.
FIG. 1*b* is a sectional view taken along 1*b*—1*b* in FIG. 1*a*.

FIG. 1, indicates a constructional panel 10. This panel extends in one direction, and is of a pre-formed cementitious material product which has bent portions 12 on both sides of the longitudinal direction of the panel having a cross-section formed into a U-shape.

Figure 2:
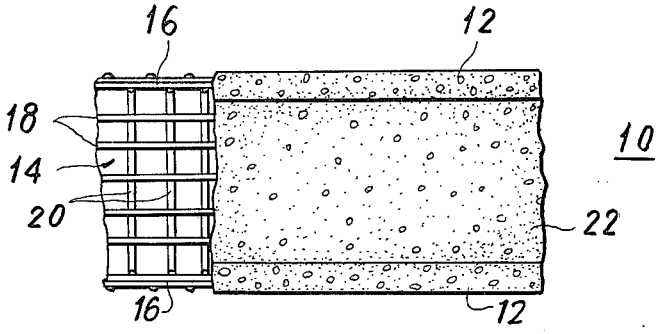
FIG. 2 is a fragmentary plane view in which a part of the panel is broken.
Figure 1A:
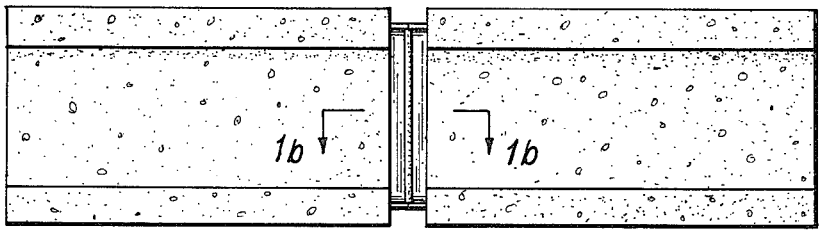
Figure 3:
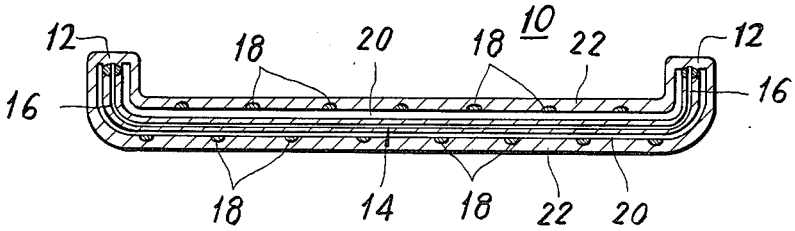
FIG. 3 is an enlarged sectional view taken on line 3—3 of FIG. 1.
Figure 1B:
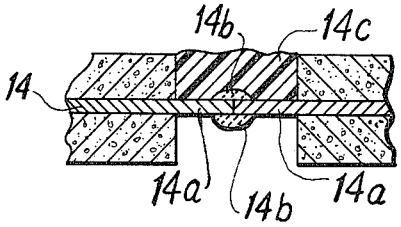

In FIG. 2, water-resistant steel sheet 14 is embedded in the panel 10 and attached to the cementitious material 22 or the reinforcement system in the panel 10. The sheet metal is made of an oblong steel having a thickness of about 1.2 mm. Portions 14*a* project beyond the cementitious material at the edges of both the sides of the water-resistant steel sheet 14, along the longitudinal direction to form the same U-shaped section as that of the constructional panel 10. Reinforcements 18 and 20 are installed intersectionally on both the surfaces of the sheet metal 14 in the transverse and longitudinal directions. The reinforcements 18 and 20 consist of the steel bars of which the cross-section is semicircular. Several points of these steel bars are welded on both the surfaces of the sheet metal 14 and to each other fixed at intersections. These reinforcements may be ribs incorporated with the sheet metal 14, high-tension deformed bars or employ a mineral fiber system. The cementitious material 22 may be asbestos cement; artificial lightweight concrete can comprise: expanded shale, expanded pearlite, an expansive admixture, air-entraining agent, a water-reducing agent, and so on. Specially, the expansive admixture checks the shrinkage cracks of the concrete, since the concrete becomes self-stressed concrete.

By welding continuously the sheet metal at edge portions 14*a*, sufficient strength and perfect watertightness can be carried out at the joints 14*b* of the longitudinal direction of the panel 10. The joint is capped over with cementitious material at 14*c*. If necessary, the parts of the reinforcement 18 may be welded at the joint.

The panel relating to the present invention is formed in accordance with the above method. A flat roof consisting of such panels is constructed as follows.

Figure 4:
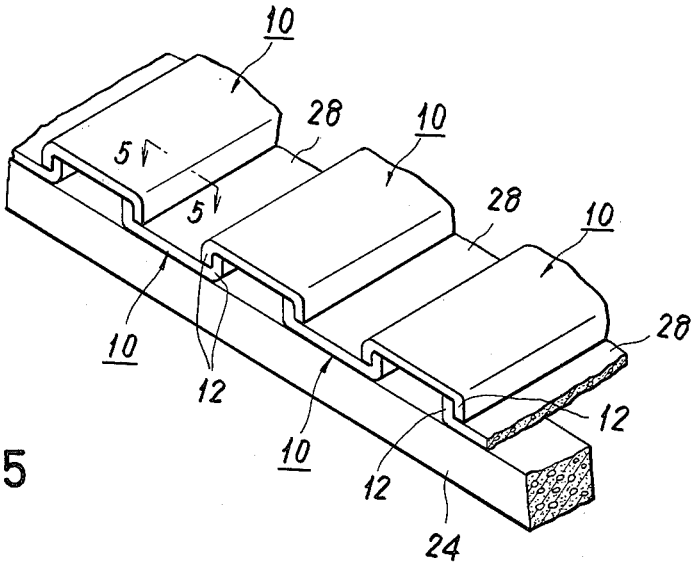
FIG. 4 is a perspective view showing a preferred embodiment, in which the constructional panels are used for a flat roof, with parts partially broken away.

FIG. 4 shows the most basic assembly of the flat roof consisting of construction panels 10. On a beam 24 installed at the top of the building, the construction panels 10 are disposed alternately in an upward and downward direction. The rising portions 12 of each panel 10 engage each other with those of the adjacent panels 10 on both the sides. Thus the cross-section of the engaged panels is connected in the form of a chain.

Figure 5:
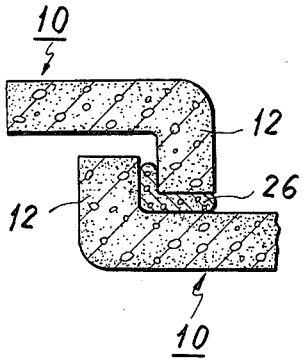
FIG. 5 is an enlarged sectional view taken on line 5—5 of FIG. 4.

As shown in FIG. 5, the spaces of the engaged portions are filled with the adhesive 26 such as mortar to fix adjoining panels to each other.

In case of a flat roof constructed by the above method, the sheet metal 14 embedded in the panel 10 and completely prevents rain water from permeating through the panel. Also, the rising portions 12 of each panel prevents rain water running into the recesses 28 of the roof from flowing into the building. Thus, the rain water would be discharged through roof gutters (not shown).

Figure 6:
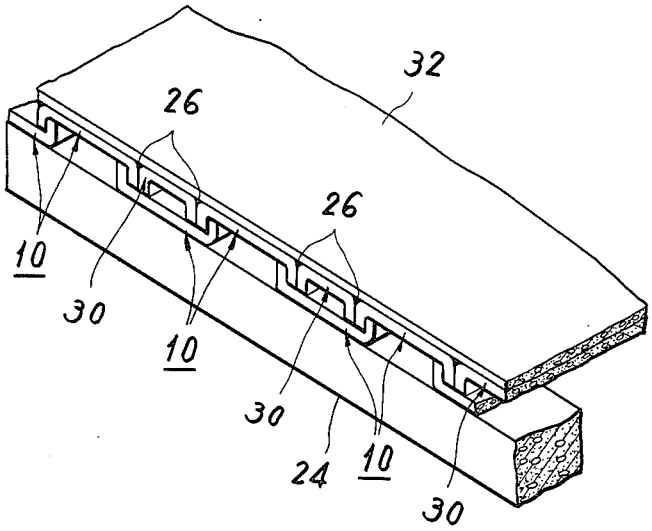
FIG. 6 is a perspective view showing another preferred embodiment, in which the constructional panels are used for a flat roof, with parts partially broken away.

In FIG. 6, after the panels 10 are assembled as shown in FIG. 4 to form a basic flat roof, panels 30 narrower in width than the panels 10 and made of the same components as the panel 10, are disposed with the inner surfaces turned downward to the recesses 28 in FIG. 4. Mortar 26 for adhesive is filled between the panels 10 and the panels 30. If necessary, a light weight mortar layer 32 may be laid on the panels.

Such roofing system may be applied to a flat roof on which man can walk and/or something can be placed.

The panels of the present invention may be applied not only to flat roofs, but also to walls or floors for which watertightness specially is required.

Many modifications and variations of the present invention are possible in light of the above teachings. It is, therefore, to be understood that within the scope of the appended claims, the invention may be practiced otherwise than as particularly described.

What is claimed is:

1. An improved pre-formed construction panel made of cementitious material having a reinforcement system, employing a sheet metal water-resisting layer of steel is embedded and attached to said cementitious material; said improvement comprising disposing said layer with respect to said cementitious material whereby transverse edge portions of said layer extend outside of said material and its longitudinal sides are bent into a U-shaped as seen in the transverse direction, and said panel reinforcement means disposed upon the entire surface of said layer of steel having strengthened joints exhibiting water-tightness by welding said U-shaped sheet metal at respective abutting edge portions forming respective joints in the longitudinal direction and providing a cementitious cap upon the joint to thereby form a monolithic construction panel.

2. An improved pre-formed construction panel in accordance with claim 1, wherein: said cementitious material consists of lightweight concrete comprising a blended expansive admixture.

3. An improved pre-formed construction panel in accordance with claim 1, wherein: said cementitious material consists of asbestos cement.

* * * * *